United States Patent [19]

Lombardo

[11] Patent Number: 4,840,383

[45] Date of Patent: Jun. 20, 1989

[54] ILLUMINATED DART

[76] Inventor: James W. Lombardo, 829 Delphi Rd., Olympia, Wash. 98502

[21] Appl. No.: 114,053

[22] Filed: Oct. 29, 1987

[51] Int. Cl.[4] ..... A63B 65/02

[52] U.S. Cl. ..... 273/420; 273/DIG. 24; 273/376; 273/423

[58] Field of Search ..... 273/416, 420, DIG. 24, 273/423, 58 G; 446/485, 219, 47; 362/32, 109, 205; 124/41 R

[56] References Cited

U.S. PATENT DOCUMENTS

| | | | |
|---|---|---|---|
| 4,302,797 | 11/1981 | Cooper | 362/109 |
| 4,340,930 | 7/1982 | Carissimi | 273/416 |
| 4,537,176 | 8/1985 | Stravitz et al. | 124/41 R |

*Primary Examiner*—Richard C. Pinkham
*Assistant Examiner*—Benjamin Layno
*Attorney, Agent, or Firm*—Jerry T. Kearns

[57] ABSTRACT

An illuminated dart contains a small battery and a light producing element. The light producing element may consist of a small bulb or a LED. Fiber optics may be received within the hollow transparent or translucent shaft of the dart for illuminating the transparent or translucent tail fins of the dart. The dart includes a switch for turning the light source element on or off. In a second embodiment of the invention, a dart board is provided with electric light bulbs in each sector of the dart board for illuminating that sector when contacts in that sector are activated by a thrown dart.

7 Claims, 4 Drawing Sheets

ILLUMINATED DART

BACKGROUND OF THE INVENTION

1. Field of the Invention

The present invention relates to illuminated darts and dart boards, and more particularly pertains to a new and improved illuminated dart with a self contained battery, light emitting element and fiber optics for illuminating the transulcent or transparent tail fins of the dart. The second embodiment of the invention pertains to a dart board provided with electrical contacts activated by a dart which illuminate the sector of the dart board which the dart has struck, thus assisting a player in determining their score.

2. Description of the Prior Art

Various types of darts are known in the prior art. A typical example of such a dart is to be found in U.S. Pat. No. 1,601,885, which issued to N. Samsel on Oct. 5, 1926. This patent discloses a dart which is retained by a suction cup to the surface of a dart board. U.S. Design Patent 131,527, which issued to O. Keene on Mar. 10, 1942, discloses a thin flat suction cup tipped dart. U.S. Design Patent 137, 804, which issued to P. Booty on May 2, 1944, discloses a dart having a needle point tip and a generally cylindrical tapered body portion. U.S. Design Patent 184,060, which issued to S. Mehr on Dec. 9, 1958, discloses a dart configured to resemble a human figure. U.S. Design Patent 219,039, which issued to E. Jaffe et al on Oct. 27, 1970, discloses a screw on tail fin section for attachment to the shaft of a dart.

While the above mentioned devices are suited for their intended usage, none of these devices provide an illuminated dart or an illuminated dart board. Further, none of the aforesaid prior art devices discloses an illuminated dart which utilizes fiber optics to illumonate translucent or transparent tail fins of the dart. Another feature of the present invention, not disclosed by the aforesaid prior art devices, is a dart board provided with electrical contacts and light bulbs for illuminating sectors of a dart board when struck by a thrown dart. Inasmuch as the art is relatively crowded with respect to these various types of darts and dart boards, it can be appreciated that there is a continuing need for and interest in improvements to such darts and dart boards, and in this respect, the present invention addresses this need and interest.

SUMMARY OF THE INVENTION

In view of the foregoing disadvantages inherent in the known types of darts now present in the prior art, the present invention provides an improved illuminated dart As such, the general purpose of the present invention, which will be described subsequently in greater detail, is to provide a new and inproved illuminated dart which has all the advantages of the prior art darts and none of the disadvantages.

To attain this, representative embodiments of the concepts of the present invention are illustrated in the drawings and make use of a dart having a translucent or transparent shaft and tail fins provided with a light source and battery within the shaft for illuminating the dart. An additional feature of the present invention is the provision of a switch on the exterior of the shaft for selectively activating the light source.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familar with patent or legal terms or phraseology, to determine quickly from a cursory inspection the nature and essence of the techinal disclosure of the application. The abstract is neither intended to define the invention of the application, which is measured by the claims, nor is it intended to be limiting as to the scope of the invention in any way.

It is therefore an object of the present invention to provide a new and improved illuminated dart which has all the advantages of the prior art darts and none of the disadvantages.

It is another object of the present invention to provide a new and improved illuminated dart which may be easily and efficiently manufactured and marketed.

It is a further object of the present invention to provide a new and improved illuminated dart which is of a durable and reliable construction.

An even further object of the present invention is to provide a new and improved illuminated dart which is susceptible of a low cost of manufacture with regard to both materials and labor, and which accordingly is then susceptible of low prices of sale to the consuming public, thereby making such illuminated darts economically available to the buying public.

Still yet another object of the present invention is to provide a new and improved illuminated dart which provides in the apparatuses and methods of the prior art some of the advantages thereof, while simultaneously overcoming some of the disadvantages normally associated therewith.

Still another object of the present invention is to provide a new and improved illuminated dart which has a self contained battery and light source for illuminating a translucent or transparent shaft and tail fins of the dart.

Yet another object of the present invention is to provide a new and improved illuminated dart which utilizes a self contained light source and battery selectively actuated by a switch on the shaft of the dart and fiber optics within the translucent or transparent dart shaft to illuminate the shaft and translucent or transparent tail fins of the dart.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
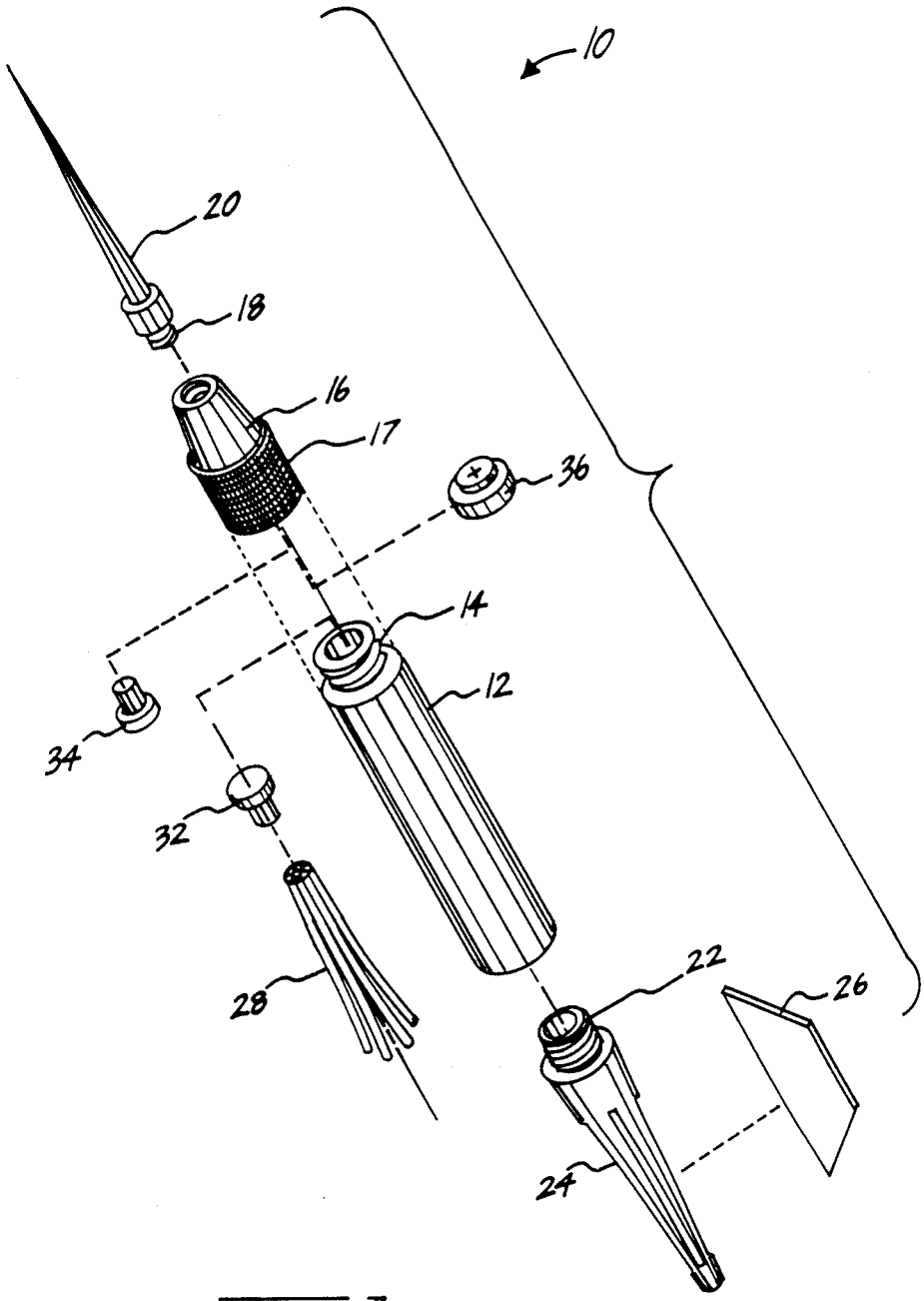
FIG. 1 is an exploded perspective view of an illuminated dart according to a first embodiment of the present invention.

With reference now to the drawings, and in particular to FIG. 1 thereof, a new and improved illuminated dart embodying the principles and concepts of the present invention and generally designated by the reference numeral 10 will be described.

More specifically, it will be noted that the first embodiment 10 of the invention includes a hollow shaft 12 preferably constructed from a transulcent or transparent plastic material. The shaft 12 is provided with a threaded portion 14 for cooperation with internal threads formed on a conical tip section 16. A slidable switch 17 is mounted on the conical tip portion 16 for actuating the illuminating light source. An externally threaded portion 18 of a point 20 cooperate with internal threads on the conical tip portion 16. A tail section 24 has an externally threaded portion 22 which cooperates with internal threads formed within a lower end of the hollow shaft 12. Translucent or transparent tail fins 26 are received within slots on the tail section 24. A bundle of optical fibers 28 are received within the hollow translucent or transparent shaft 12 and transmit light to the translucent or transparent tail section 24 and translucent or transparent tail fins 26. A pair of light sources 32 and 34 are received within the conical tip portion 16 for providing a source of light for illuminating the dart. A battery 36 is also received within the conical tip portion 16 between the light sources 34 and 32. The battery 36 may be of any conventional type and light sources 32 and 34 may comprise small bulbs or light emitting diodes. The conical tip portion 16 may be constructed as a replaceable disposable unit for replacing the light sources 32, 34 and the battery 36.

Figure 2:
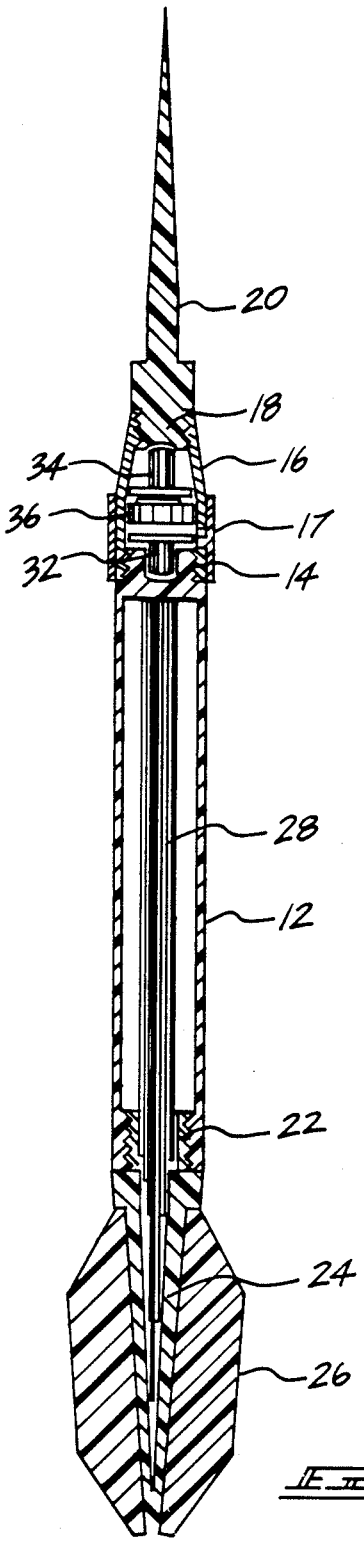
FIG. 2 is a cross sectional view of the illuminated dart according to the first embodiment of the present invention.

With reference now to FIG. 2, it may be seen that the optical fibers 28 extend axially within the hollow translucent or transparent shaft 12 into the translucent or transparent tail section 24. The translucent or transparent tail fins 2l may optionally be embedded with the optical fibers for the illumination thereof. The switch 17 is slidable on the conical tip portion 16 to selectively connect the battery 36 to both of the light sources 32 and 34. The point portion 20 of the dart may also be constructed from a translucent or transparent material and provided with fiber optic illuminatiion, as may be used in a soft til board or may be constructed as a conventional metal tip.

Figure 3:
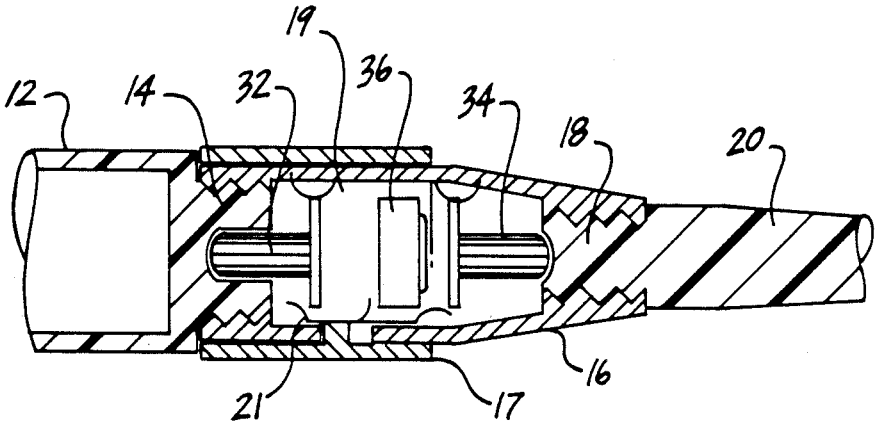
FIG. 3 is an enlarged partial cross sectional view of the dart of the first embodiment of the present invention illustrating a switch for actuating the dart illuminating light sources in an off position.

With reference now to FIG. 3, the details of the switch 17, will now be described. A first, stationary resilient spring contact 19 is mounted in the interior of the conical tip portion 16 and serves to connect the positive terminals of each of the light sources 32 and 34 to the positive terminal of the battery 36. A second resilient spring type electical contact 21 is mounted for sliding movement on an inner flange of the slidable switch 17. In the illustrated position the contact 21 is out of engagement with the negative terminals of the battery 36 and the negative terminals of the light sources 32 and 34.

Figure 4:
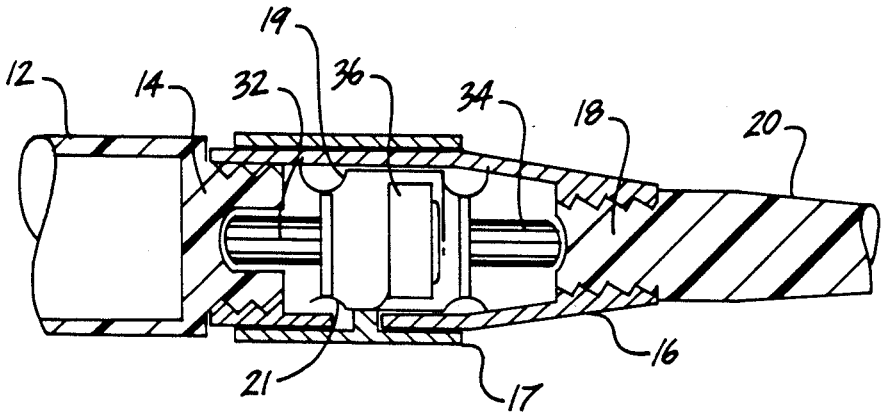
FIG. 4 is a partial cross sectional view of a dart according to the first embodiment of the present invention illustrating the actuating switch in an on position.

With reference now to FIG. 4, the switch 17 is illustrated in an on position. In this position, the slidable switch 17 is slid forwardly on the conical tip portion 16 thus moving the contacts 21 into engagement with the negative terminals of the light sources 32 and 34 and the negative battery terminal 36, thus completing an electrical circuit and energizing the light sources 32 and 34. As previously mentioned, the light sources 32 and 34 are not limited to the illustrated type, but may include any conventional type of small bulb or LED. Likewise, any conventional type of battery 36 may be used. A variety of other types of switches may be utilized in place of the sliding switch 17, for example a rotatable type switch.

Figure 5:
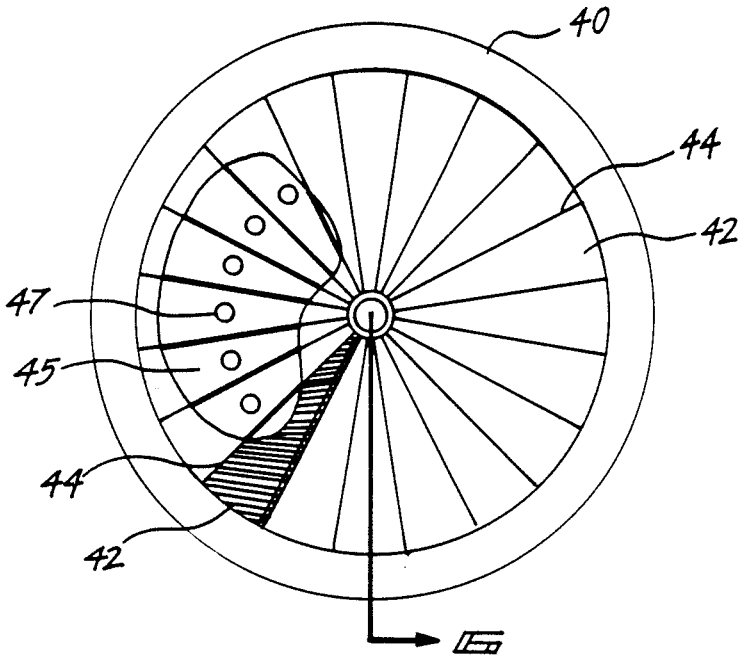
FIG. 5 is a front plan view, partially cut away, of a dart board according to a first embodiment of the present invention.

With reference now to FIG. 5, a first embodiment of an illuminated dart board of the present invention will now be described. The dart board 40 includes a plurality of sectors 42, each representative of a different scoring zone. Each of the sectors 42 is provided with a plastic mesh covering which forms a grid of openings for the reception of the tip portion of a dart. As illustrated in the cut away portion of FIG. 5, each of the sectors 42 is provided with a movable electrical contact 45.

Each sector 42 also includes a bulb 47 for illuminating that sector. Each sector 42 is separated from the adjacent sectors by a partition wall 44 of an opaque material. Thus, in use, when a particular sector 42 is struck by a dart, the electrical contact 45 is depressed, making a circuit and illuminating the bulb 47 within that particular sector. Thus, the dart board 40 serves to help a player to determine the score achieved by each throw of a dart from a considerable distance.

Figure 6:
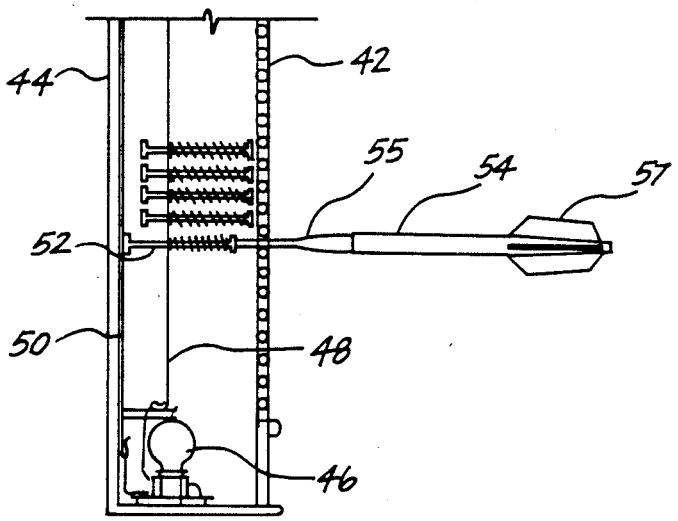
FIG. 6 is a cross sectional view of an illuminated dart board and dart according to a second embodiment of the present invention.

With reference now to FIG. 6, a cross sectional view of a dart board similar to the one illustrated in FIG. 5, is provided. In this second embodiment of dart board, each sector of the dart board 42 is provided with a plastic mesh outer covering creating a grid of spaced apertures for the reception of the tip of a thrown dart.

Within each sector 42 a bulb 46 is provided which is connected between a pair of contacts 48 and 50. These contacts are connected to opposite terminals of a conventional battery or external power 110V received within the dart board. A completed electrical circuit is achieved by a dart depressing one of a plurality of spring loaded contacts 52 which complete a circuit between the contacts 48 and 50, thus illuminating the bulb 46. Opaque partitions 44 prevent the illumination of adjacent sectors. The dart 54, utilized with this type of dart board, has a blunted translucent or transparent tip portion 55 and may be provided with internal fiber optics for transmitting light from bulb 46 to the translucent or transparent tail fins 57 of the dart 54.

Thus it may be seen that the present invention contemplates two different types of electrical contacts for illuminating particular sectors of a dart board. In the first type of electrical contact described in conjunction with the dart board of the FIG. 5 embodiment, the electrical contact 45 is a one piece spring loaded unit which extends beneath an open mesh covering each sector 42 of the dart board. In the second embodiment of the dart board according to the present invention, a plurality of individual spring loaded contacts 52 are provided for completing a circuit to illuminate a light bulb 46 within each sector.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An illuminated dart, comprising:
a tip;
a hollow conical tip section connected to said tip;
a light source received within said hollow conical tip section;
a battery within said hollow conical tip section;
a switch on an external surface of said hollow conical tip section for selectively connecting and disconnecting said battery from said light source;
a hollow shaft formed from a transparent or translucent material connected to said conical tip section;
a tail section formed from a translucent or transparent material connected to said hollow shaft;
tail fins formed from a transparent or translucent material on said tail section;
and
optical fibers in said hollow shaft for transmitting light from said light source to said tail section and said tail fins.

2. The illuminated dart of claim 1, wherein said light source comprises at least one light emitting diode.

3. The illuminated dart of claim 1, wherein said light source comprises at least one electric light bulb.

4. An illuminated dart, comprising:
tip means;
hollow shaft means connected to said tip means;
electrical illumination means in said shaft means;
means for energizing said illumination means;
tail fin means connected to said shaft means;
a hollow conical tip section connected to one end of said hollow shaft means, said tip means being connected to said conical tip section;
and
said electrical illumination means and said energizing means received within said hollow conical tip section.

5. An illuminated dart, comprising:
tip means;
hollow shaft means connected to said tip means;
electrical illumination means in said shaft means;
means for energizing said illumination means;
tail fin means connected to said shaft means;
and
means for transmitting light from said illumination means to said tail fin means.

6. The illuminated dart of claim 5, wherein said transmitting means comprises optical fibers received within said hollow shaft means.

7. The illuminated dart of claim 5, wherein said tail fin means comprises a transparent or translucent material.

* * * * *